US005879481A

United States Patent [19]

Price

[11] Patent Number: 5,879,481

[45] Date of Patent: Mar. 9, 1999

[54] HEAT TREATMENT OF ALUMINIUM-LITHIUM ALLOYS

[75] Inventor: Howard J. Price, Liverpool, United Kingdom

[73] Assignee: British Aerospace Public Limited Company, Farnborough, United Kingdom

[21] Appl. No.: 686,011

[22] Filed: Jul. 25, 1996

Related U.S. Application Data

[63] Continuation of PCT/GB95/02878 Dec. 11, 1995.

[30] Foreign Application Priority Data

Dec. 10, 1994 [GB] United Kingdom ..... 9424970

[51] Int. Cl.[6] ..... C22F 1/04

[52] U.S. Cl. ..... 148/698; 148/535

[58] Field of Search ..... 148/535, 698

[56] References Cited

U.S. PATENT DOCUMENTS 3,359,142 12/1967 Ward ..... 148/535
4,812,178 3/1989 Dubost ..... 148/12.7
5,076,859 12/1991 Rioja et al. ..... 148/12.7
5,439,536 8/1995 Cho ..... 148/697

FOREIGN PATENT DOCUMENTS 0281076 3/1988 European Pat. Off. .
WO 91/17281 11/1991 WIPO .

OTHER PUBLICATIONS

M. Peters, "Aluminium–Lithium Proceedings 6th Int. Conf.", 1991, DGM, Oberursel, DE XP 000565929, pp. 137–142 M. Furukawa et al, Split Aging of Chill Cast AL–LI–ZR Alloys see p. 138, paragraph 2; figure 2.

*Primary Examiner*—Patrick Ryan
*Assistant Examiner*—M. Alexandra Elve
*Attorney, Agent, or Firm*—Nixon & Vanderhye P.C.

[57] ABSTRACT

A method of heat treating an aluminum—lithium alloy is provided. The method includes carrying out a succession of at least two artificial aging steps. The first such step is carried out within a first temperature range and one or more further steps are carried out within successively reduced temperature ranges to promote the precipitation of the δ' phase of the alloy.

8 Claims, 5 Drawing Sheets

349 MPa
318 MPa
65000 HOURS
PRIOR ART
8090 T81
8090 RS-W
AGEING
THERMAL EXPOSURE
AGEING
THERMAL EXPOSURE
T81
RS-W
0.2% PROOF STRESS (MPa)
360
340
320
300
280
260
100
1000
10000
1
2
3
4
5
Log 10
AGEING/THERMAL EXPOSURE TIME (HOURS)

HEAT TREATMENT OF ALUMINIUM-LITHIUM ALLOYS

This is a continuation of PCT application PCT/GB95/02878, filed Dec. 11, 1995.

BACKGROUND OF THE INVENTION

1. Field of the Invention

This invention relates to the heat treatment of aluminium-lithium alloys and in particular to such heat treatment for the strengthening of such alloys and for the optimisation of such alloys' plane stress fracture toughness. Such alloys are known in particular for use in aircraft skin construction, and more particularly for commercial aircraft fuselage, wing and empennage construction. In this application in particular the low density, high stiffness and excellent fatigue properties of aluminium-lithium alloys enable weight savings to be achieved to maximise profitability of the aircraft.

2. Discussion of Prior Art

Prior Art references which are relevant to this invention known at the time of the invention are as follows. "Effect of thermal exposure at 70° C. on the performance of damage tolerant aluminium-lithium alloy sheet." February 1995. Reference DRA/SMC/WP952008 by D. S. McDarmaid; "Mechanical properties of 2024-T3 aluminium alloy sheet. December 1991. Reference TR91071 by D. S. McDarmaid, C. E. Thomas and C. Wheeler.

The aluminium-lithium (Al—Li) alloys registered with the ALUMINUM ASSOCIATION as AA8090 and AA2091 (hereinafter referred to without the "AA" prefix) in recrystallised sheet form and under-aged tempers have been shown to possess attributes of "Damage Tolerance" in that fatigue crack growth rates are commendably slow coupled with reasonably high levels of plane stress fracture toughness (Kc). A such, both products have been extensively investigated as potential alternatives to the currently most widely used materials for civil aircraft skin applications, in particular for fuselages eg alclad 2024 T3 and 2014A T4 sheet, where the density reduction associated with the lithium-bearing alloys would enable considerable amounts of weight to be saved. 8090 in plate form has also been investigated for upper and lower wing skin and empennage applications and may also be considered for upper wing skins.

In addition to the requirement for damage tolerance there are several other necessary characteristics which any new skin material and particularly fuselage wing and empennage skin materials must possess. These include adequate strength, good corrosion resistance and an often unstated but very important requirement of long-term thermal stability, ie the ability to withstand prolonged periods at moderately elevated temperatures without an appreciable or unacceptable loss in any of the key attributes. For a sub-sonic civil aircraft fuselage the worst case from a consideration of thermal instability involves on the ground exposures to the combined effects of high ambient temperatures and intense solar radiation. It is generally accepted that in tropical conditions fuselage skin temperatures of up to 70°–85° C. can be achieved when the sun is at or near its zenith. Over the life of an aircraft this could, in the worst case, represent a cumulative high temperature exposure of approximately 65000 hours (eg 6 hours per day for 30 years) although such an exposure would only be achieved for aircraft either stored in desert conditions or operated irregularly from tropical bases. Thermal stability is also one aspect of concern when considering the use of Al—Li alloys for wing and empennage skin applications.

The 8090 and 2091 alloys have been primarily investigated for fuselage skin applications in the T81 and T84 conditions respectively. The T81 condition for 8090 is achieved by artificial age hardening ("ageing") from the T31 condition (ie solution treated and controlled stretched) for 24 hours at 150° C. whilst the T84 condition for 2091 is achieved by ageing from the T3 condition for 12 hours at 135° C. following a slow ramp up from ambient to 135° C. These treatments are intended to produce products which mimic the mechanical properties of alclad 2024 T3 (ie the lower limit for 0.2% Proof Stress has been set as approximately 270 MPa) in order that substitutional applications can more easily be considered. There is, also, the widespread perception that Al—Li alloys require static strengths at least equivalent to alclad 2024 T3 to be successful in the fuselage skin application. This is not necessarily so since the increase in Young's Modulus associated with the lithium content is capable of more than off-setting any slight reduction in strength which might now be seen to be required in order to properly satisfy a real requirement for very high fracture toughness and good impact resistance.

Despite the use of artificial ageing treatments, both the Al—Li products referred to are known to lack thermal stability in the temperature range 70°–85° C. and an increase in strength coupled with a disproportionately large reduction in Kc results after relatively short isothermal exposures (ie a very significant effect after 1000 hours). This inverse relationship between strength and Kc for Al—Li alloys has been demonstrated on many occasions. Given that the initial toughness levels for both alloys aged to their respective prior art conditions (ie T81 and T84 for 8090 and 2091 respectively) are marginal for the intended application when compared to alclad 2024 T3 (the current industry standard) this absence of thermal stability and the pernicious effect on toughness of even apparently very small increases in strength is widely regarded as a major contributory factor accounting for the current lack of any significant civil aircraft fuselage applications.

The cause of thermal instability is attributed to an on-going precipitation of δ' ($Al_3Li$). The reason for the continued precipitation of δ', and hence the thermal instability, is that there is an inverse relationship between the equilibrium volume fraction of δ' and temperature (ie the equilibrium volume fraction increases as temperature is reduced). The high rate of diffusion of lithium in aluminium ensures that the formation of δ' is not effectively diffusion rate controlled until the temperature falls some considerable way below the exposure temperature of concern. It therefore follows that even extensive ageing at the stated prior art ageing temperatures (ie 135°–150° C.) will never achieve anything approaching a complete precipitation of δ' and a high thermodynamic driving force for on-going precipitation, coupled with adequate rates of lithium diffusion, will exist at temperatures at or close to (below) the maximum thermal exposure temperatures considered. Instead, extensive ageing at these "higher" temperatures only serves to increase the volume fraction of other phases such as S' ($Al_2CuMg$) leaving a structure overly high in strength but relatively low in δ'. Subsequent long-term thermal exposure therefore results in a large increase in the δ' volume fraction, an increase in strength and embrittlement.

To illustrate the effect of on-going δ' precipitation duplicate samples of a batch of (hereinafter referred to as "Batch 1" material) 8090 T81 were given a range of thermal treatments prior to being exposed to an elevated temperature for a considerable length of time. The composition in weight percent of the Batch 1 material was:

| Li | Cu | Mg | Fe | Zr | Al |
|---|---|---|---|---|---|
| 2.23 | 1.14 | 0.79 | 0.045 | 0.06 | Remainder |

The treatments chosen included a 10 minute "reversion" at 200° C. from the T81 condition (ie causing a drop in 0.2% Proof Stress due to δ' dissolution), followed by a re-age of 170° C. for 4 hours (ie to achieve a recovery to approximately the original level of T81 0.2% Proof Stress and, finally, an extensive over-ageing treatment of 220° C. for 12 hours in addition to the T81 initial treatment.

After tensile testing one long transverse (LT) oriented sample representative of each condition the duplicate samples of all conditions including the T81 "Control" condition were then exposed for 920 hours at 100° C. in order to crudely represent a lifetime's exposure to tropical temperatures. The results of the mechanical property tests and electrical conductivity measurements made are shown in Table 1.

It is clear from Table 1 that the on-going precipitation at 100° C. results in a considerable increase in strength. The reverted material recovers to a higher strength than is the case for the Control condition indicating the ineffectiveness of reversion as a means of increasing the toughness of 8090 where consideration must also be made of thermal instability effects since the initial benefit of reversion is short-lived and the treatment can, ultimately, be expected to be harmful as it results in a higher final strength after thermal exposure. The increase in strength of the reverted material over and above the un-reverted material at the conclusion of the thermal exposure is attributed to the additional S' precipitated during the reversion process. Similarly, the additional increase in strength of the reverted and re-aged material following thermal exposure compared with either of the T81 and T84 plus reversion conditions is attributed to the increased S' associated with 4 hours at 170° C.

Finally, the use of over-ageing is seen to be completely ineffective at achieving stability with a 48 MPa rise in 0.2% Proof Stress being apparent at the conclusion of the 920 hour exposure. Similar results for all starting conditions would be anticipated for exposure at, say, 70° C. and an even higher equilibrium volume fraction of δ' would be realisable at this temperature than at 100° C. although the exposure time required to achieve saturation would be that much greater at the lower temperature due to the reduced diffusion rates.

It should be noted that the Batch 1 8090 sheet had a T81 LT 0.2% Proof Stress of 293 MPa and which then reached what is believed to be a δ' -saturated 0.2% Proof Stress of 320 MPa following 920 hours thermal exposure at 100° C., ie a rise of 27 MPa.

SUMMARY OF THE INVENTION

According to the invention an improved method of heat treating Aluminium-Lithium alloy includes carrying out a succession of at least two artificial ageing steps, the first such step being carried out within a first temperature range and at least one further step being carried out within a successively reduced temperature range.

The specific promotion of δ' precipitation is thus achieved and for appropriately selected temperature ranges capping of the S' volume fraction is achieved in conjunction with this to attain a condition of use with adequate but not excessive initial strength which is compatible with the requirement of high fracture toughness, with the ability to retain adequate fracture toughness following long term exposure to moderately elevated temperatures. Where other appropriate temperature ranges are selected according to the invention it is possible to combine the promotion of δ' precipitation with high levels of S' volume fraction thereby resulting in a level of strength that is higher than otherwise would be possible for an alloy of this composition for a given total ageing treatment time.

The conclusion reached was that thermal stability at, say, 70°–85° C. can only be achieved by the realisation of an equilibrium volume fraction of δ' for this temperature. The achievement of δ' saturation needs to be achieved without realising too high a 0.2% Proof Stress level which would otherwise be incompatible with the omnipresent requirement for high fracture toughness.

Ageing trials according to the invention were then conducted using an 8090 T31 starting condition material which was arrived at by re-solution treatment and controlled stretching of some Batch 1 8090 T81 material. NB Re-solution treatment was carried out at 505° C. to avoid grain growth. Ageing commenced at 150° C. but for a short duration (very much less than the prior art 24 hours at 150° C.) followed by progressive reductions in temperature and increases in ageing time in order that the volume fraction of S' and phases other than δ' could be capped and a high volume fraction of δ' realised. In this way it is now believed that a condition with a superior balance between δ' and S' precipitate volume fractions and precipitate size distribution can be achieved with a relatively low level of 0.2% Proof Stress (and, hence, high fracture toughness) and with limited capacity for further strengthening by on-going precipitation of δ'.

The adoption of this form of retrogressive step-wise (RS-W) ageing treatment according to the invention fully recognises the need to precipitate sufficient S' to prevent what would otherwise be a plastic deformation mechanism dominated by intense planar slip—a deformation mechanism which would, if not properly inhibited by the presence of S', then result in low levels of ductility, particularly in the longitudinal direction.

Figure 1:
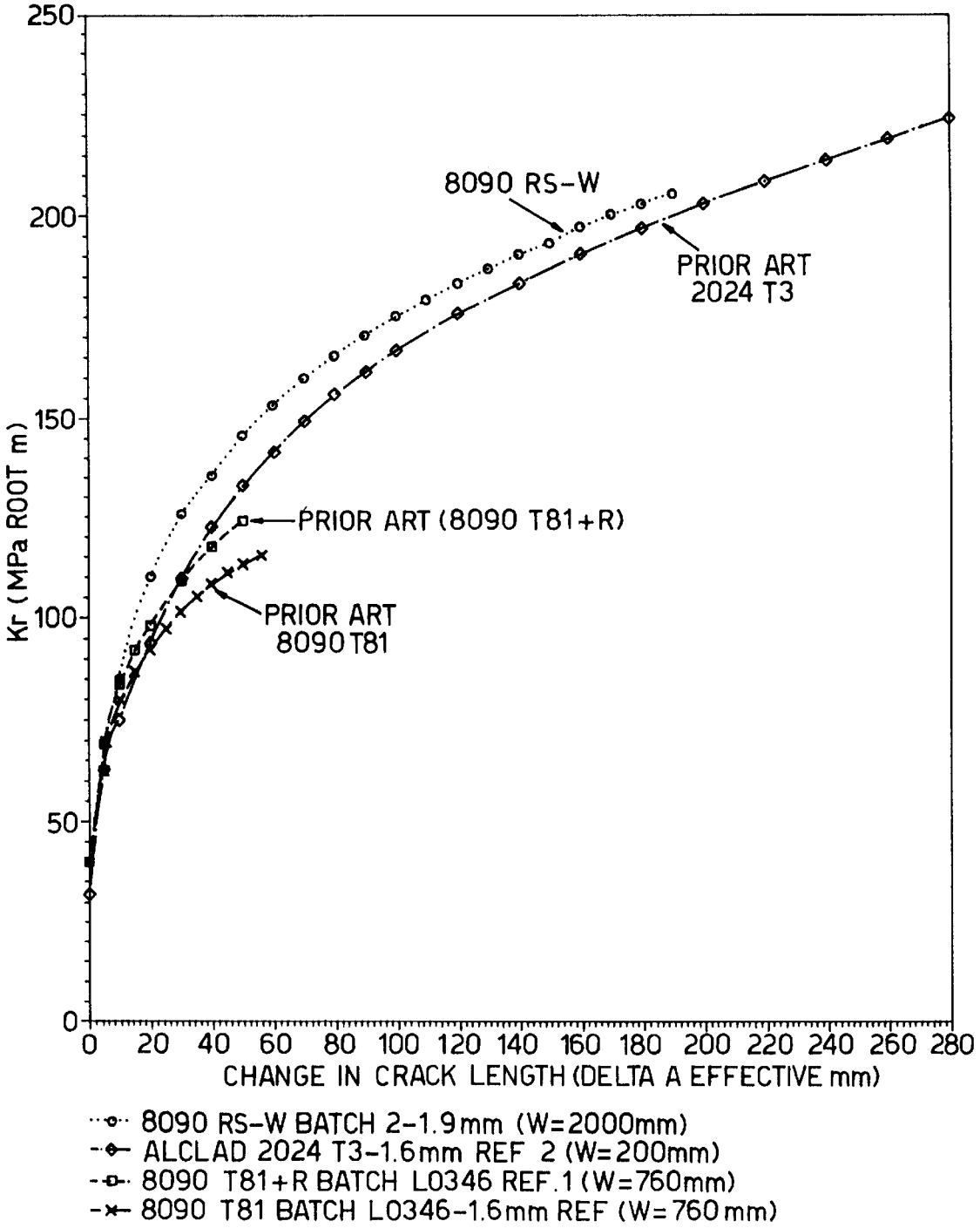
FIG. 1 is a graph comparing fracture toughness characteristics of the present invention with the prior art.

During this initial work with re-solution treated Batch 1 material a large number of temperature/time RS-W ageing combinations were studied. Of particular note were treatments based around a 4-step RS-W ageing sequence commencing with either 1 hour or 3 hours at 150° C. followed by periods at 135° C., 120° C. and 100° C. as shown below:

1 hour/150°+6/135°+3/120°+50/100° C. (see Table 2A)
1 hour/150°+6/135°+8/120°+50/100° C. (see Table 2B)
1 hour/150°+61/135°+16/120°+50/100° C. (see Table 2C)
1 hour/150°+12/135°+6/120°+50/100° C. (see Table 2D)
1 hour/150°+12/135°+16/120°+50/100° C.(see Table 2E)
3 hours/150°+12/135°+6/120°+50/100° C.(see Table 2F)
3 hours/150°+6/135°+16/120°+50/100° C.(see Table 2G)

These treatments and the resulting mechanical properties and electrical conductivity results, both during the ageing sequence and as a result of various periods of thermal exposure at 85° C. and 70° C., are shown in Tables 2A–2G.

Subsequently, a new batch of 8090 sheet was obtained (hereinafter referred to as "Batch 2") which had not been previously solution heat treated. This material was used for solution heat treatment and ageing trials in order to optimise the process of RS-W ageing. The composition in weight percent of the Batch 2 sheet material was:

| Li | Cu | Mg | Fe | Zr | Al |
|---|---|---|---|---|---|
| 2.26 | 1.21 | 0.69 | 0.047 | 0.06 | Remainder |

From the results of the Batch 1 trials it was realised that the 135° C. step was apparently resulting in excessive ageing of the non-δ' phases and so might be discontinued. It was also recognised that if the fuselage structure was to be adhesively bonded (ie the attachment of stringers to skins) then either a 150° C. or a 120° C. curing resin system such as REDUX (registered trade mark) 775 (CIBA) or AF163-2 (3M), or similar, would most likely be used. In the case of REDUX 775 (150° C. cure) the cure cycle could be combined with the 150° C. RS-W ageing step and all subsequent steps would then be applied to the bonded skin/stringer assembly. In which case there would be an economic advantage in reducing the temperature of the second step such that the assembly would not require an over-pressure to protect the (phenolic) adhesive. This would be achieved by reducing the temperature of the second step from 135° C. to 125°–120° C. whereas the continued use of a 135° C. ageing step would necessitate that this ageing step took place in an autoclave or bonding press. If a 120° C. cure resin system such as AF163-2 was to be used. then the cure cycle could be introduced after completion of all ageing steps of greater than 120° C. No over-pressure would be required for any selection of ageing temperature equal to or less than 120° C.

A series of RS-W ageing trials was undertaken using Batch 2 material which had been solution treated at 530° C. and controlled stretched 1.75%±0.25%. Of note are the following RS-W treatments:

1 hour/150°+6/135°+8/120°+50/120° C. (included to benchmark Batch 2 material with Batch 1) (See Table 3A)
1 hour/150°+8/120°+24/105°+24/95° C. (See Table 3B)
1 hour/150°+16/120°+24/105°+24/95° C. (See Table 3C)
1 hour/150°+8/125°+24/105°+24/95° C. (See Table 3D)
1 hour/150°+16/125°+24/105°+24/95° C. (See Table 3E)
1 hour/135°+8/120°+24/105°+24/95° C. (See Table 3F)
1 hour/135°+16/120°+24/105°+24/95° C. (See Table 3G)
2 hour/120°+32/105°+24/95° C. (see Table 3H)
8 hour/120°+24/105°+24/95° C. (see Table 3J)

These trials showed that the 135° C. step was superfluous and that a direct transition from about 150° C. to about 120° C. (or 125° C.) was preferable. The treatments commencing at 135° C. and 120° C. had some merit but produced a fully heat treated condition that was low in strength but which ultimately, on thermal exposure, rose to levels comparable with the treatments which commenced at 150° C. and so there was expected to be no benefit in terms of usable toughness.

On the basis of the tensile test data from the above tests the sequence 1 hour/150° C.+8/120° C.+24/105° C.+24/95° C. was selected for further investigation and refinement. This included ageing full-sized sheets to enable wide panel fracture toughness testing to be carried out.

The result of the first fracture toughness test carried out on 1.9 mm thick Batch 2 material aged 1 hour/150° C.+8.120° C.+24/105° C.+24/95° C. is shown in FIG. 1 in the form of a fracture resistance curve (R-curve). The result is compared to R-curves applicable to prior art 8090 T81 and reverted 8090 T81 (Reference 1), an unstable condition previously shown to produce improvements in toughness together with alclad 2024 T3 (Reference 2).

Figure 2:
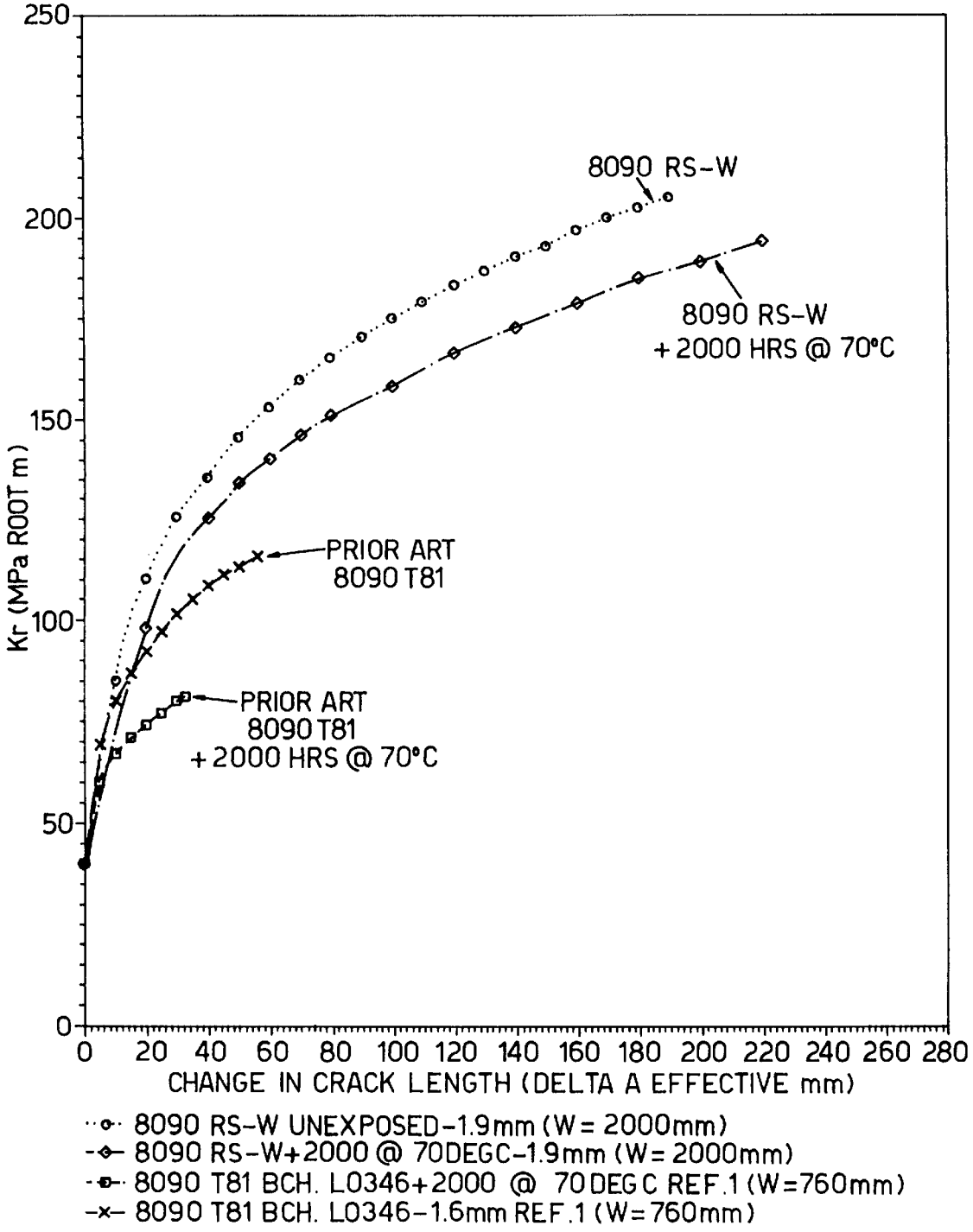
FIG. 2 is a graph comparing fracture toughness characteristics of the present invention with the prior art.

It can be seen that the application of the RS-W treatment of the invention has produced a condition of very high toughness and which is comparable to, or better than, alclad 2024 T3. This is the first known reported occurrence of 8090 sheet exceeding the toughness of alclad 2024 T3. A second 1.9 mm thick 8090 sheet was given the above RS-W treatment followed by 2000 hours thermal exposure at between 70° C. and 75° C. The R-curve for this material is shown in FIG. 2 together with the un-exposed R-curve. Also shown is an R-curve for prior art 8090 T81 material with and without 2000 hours thermal exposure at 70° C. (Reference 1). It can be seen that although the RS-W material has suffered a reduction in toughness the reduction (approximately 6%) is very much less and from a much higher starting level than was the case for prior art 8090 T81. NB: The comparative data extracted in graphical form from References 1 and 2 is presented for illustrative purposes only and is not intended to limit the invention.

Trials were also conducted to determine sensitivity to temperature and time variations for the first ageing step and to determine whether the final step of 24 hours/95° C. could usefully be truncated. The results of these trials are shown in Tables 4A, 4B and 4C for Batch 2 material.

It was established that the first step could be shortened to 0.75 hours or extended to 1.25 hours without undue deleterious effects being apparent. It was also found that the final step could be truncated to 8 hours for material given 1 hour/150° C. or 1.25/150° C. without a significant effect on the final strength being apparent and, for applications where strength is not critical, this step can be omitted completely and/or the shorter 150° C. ageing treatment adopted. The preferred ageing treatment identified as a result of this work is:

1 hour/150° C.+8/120° C.+24/105° C.+8/95° C.

The 4-step treatment has the advantage of maximising the degree of benign strengthening (ie strengthening due to δ' precipitation) without requiring an overly long ageing treatment which might be uneconomic.

The treatment was found to be reasonably insensitive to ageing temperature within the range ±5° C. (all steps) and to variations in the length of individual treatments within the range ±25% of the stated time.

Figure 3:
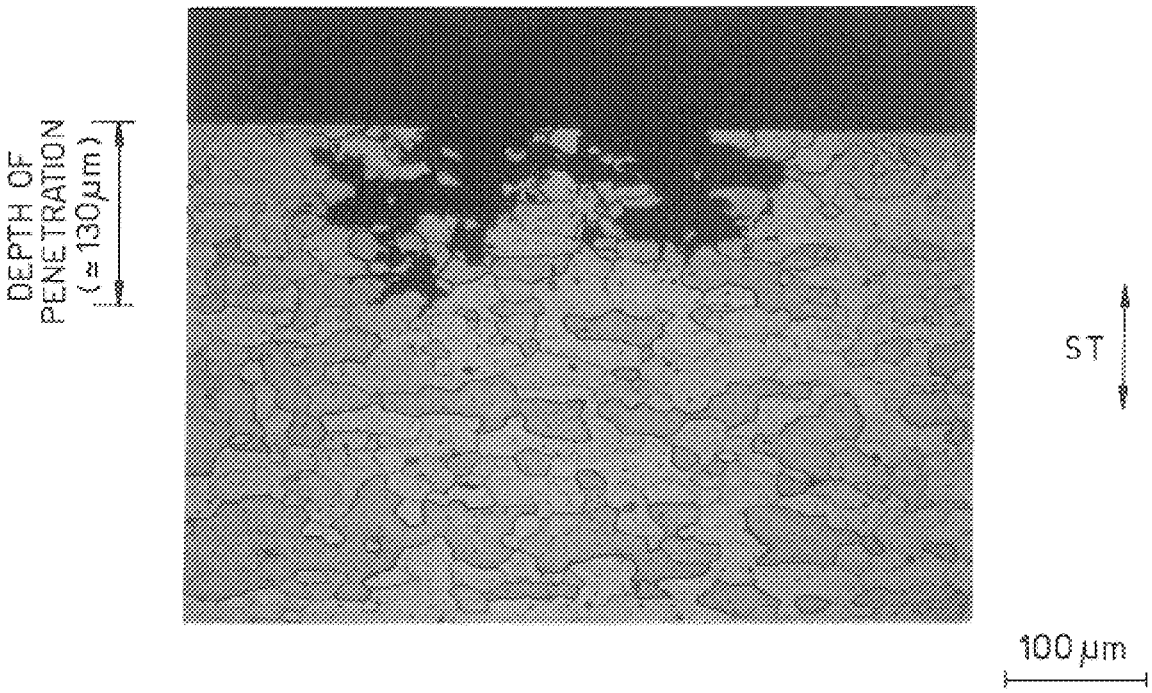
FIG. 3 is a photomicrograph of a cross section of Al—Li alloy in accordance with the present invention.
Figure 4:
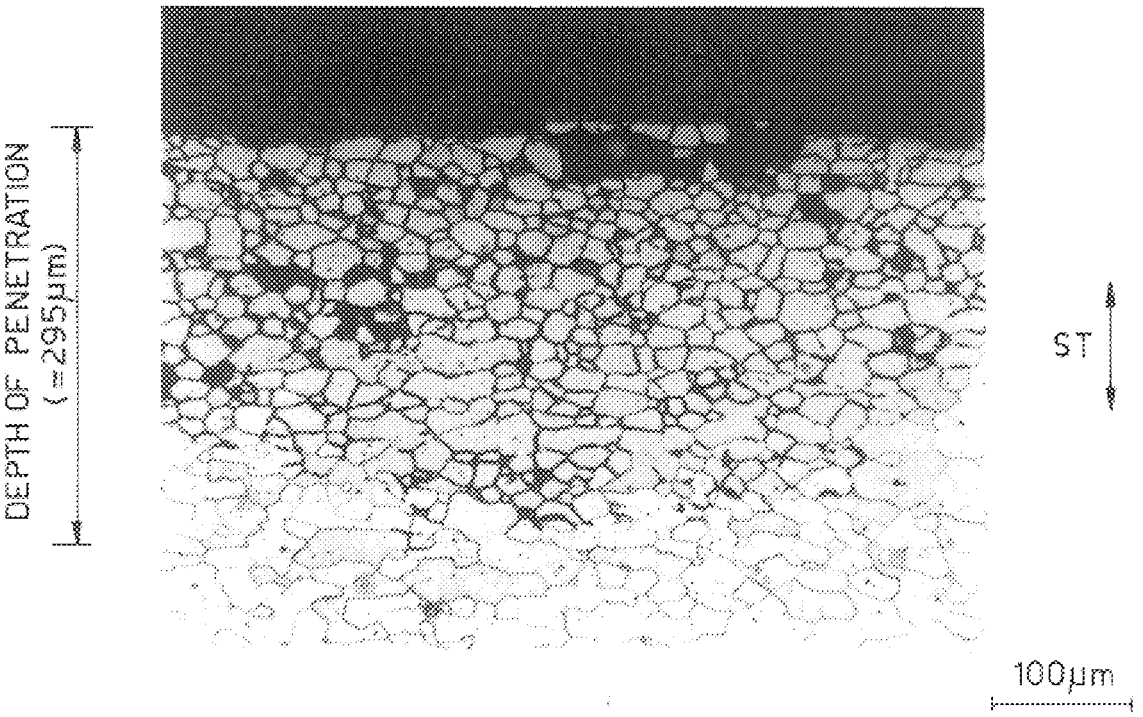
Fig.4. PRIOR ART
FIG. 4 is a photomicrograph of a cross section of T81 aluminum.

This preferred ageing treatment was also found to engender optimum resistance to intergranular corrosion as measured by the ASTM G110 corrosion test with depth of corrosion penetration limited to approximately 150 μm and with a tendency to form localised corrosion pits with very little or virtually no intergranular attack present. This is in very marked contrast to 8090 T81 which often exhibits in excess of 250°–300 μm of attack and which is characterised by an extended network of intergranular penetration. The forms of intergranular attack for the RS-W and T81 conditions are shown in FIGS. 3 and 4 respectively.

Several more full-sized sheets were then given the preferred ageing treatment of 1 hour/150°+8/120°+24/105°+8/

Figure 5:
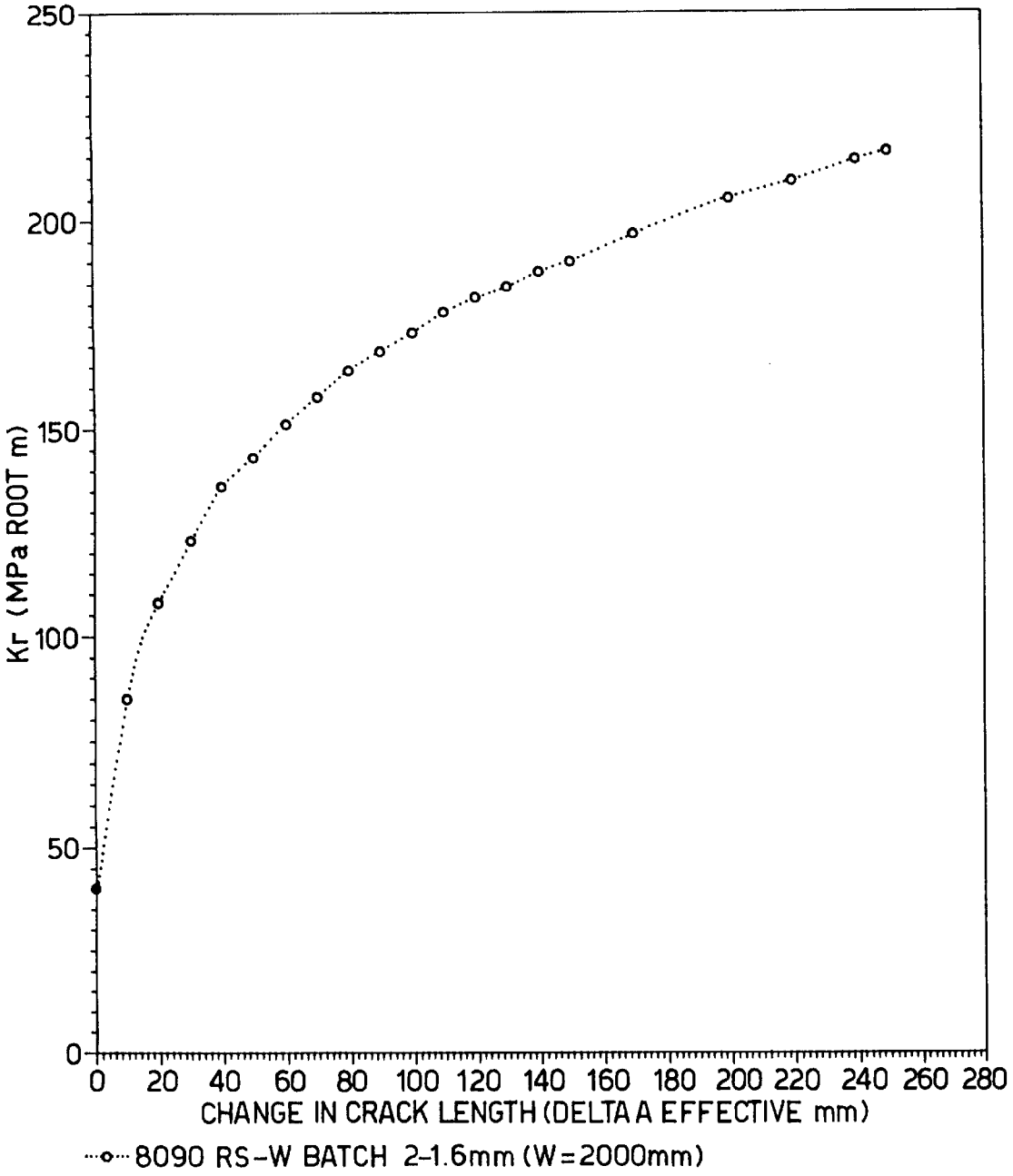
FIG. 5 is a graph of fracture toughness characteristics of an embodiment of the present invention.

95° C. These sheets were intended to establish the initial toughness level for 1.6 mm sheet and to provide specimens for long-term thermal exposure such that the R-curves of thermally sensitised material could be determined. The results of an R-curve test on this material in the fully heat treated condition are shown in FIG. 5. The R-curve is slightly lower than for the 1.9 mm material and the difference is considered to be due to the rolling schedule associated with 1.6 mm gauge, to differences in lithium depletion, to a thickness effect per se, or to a combination of these effects.

A sheet of Batch 2 material sufficient for a large number of tensile tests has been given the preferred ageing treatment and has completed a 2000 hour thermal exposure test at 70° C. together with comparative Batch 2 material initially aged to the T81 condition. The results are shown in Table 5 and plotted as 0.2% Proof Stress versus $Log_{10}$ Exposure Time in FIG. 6.

Figure 6:
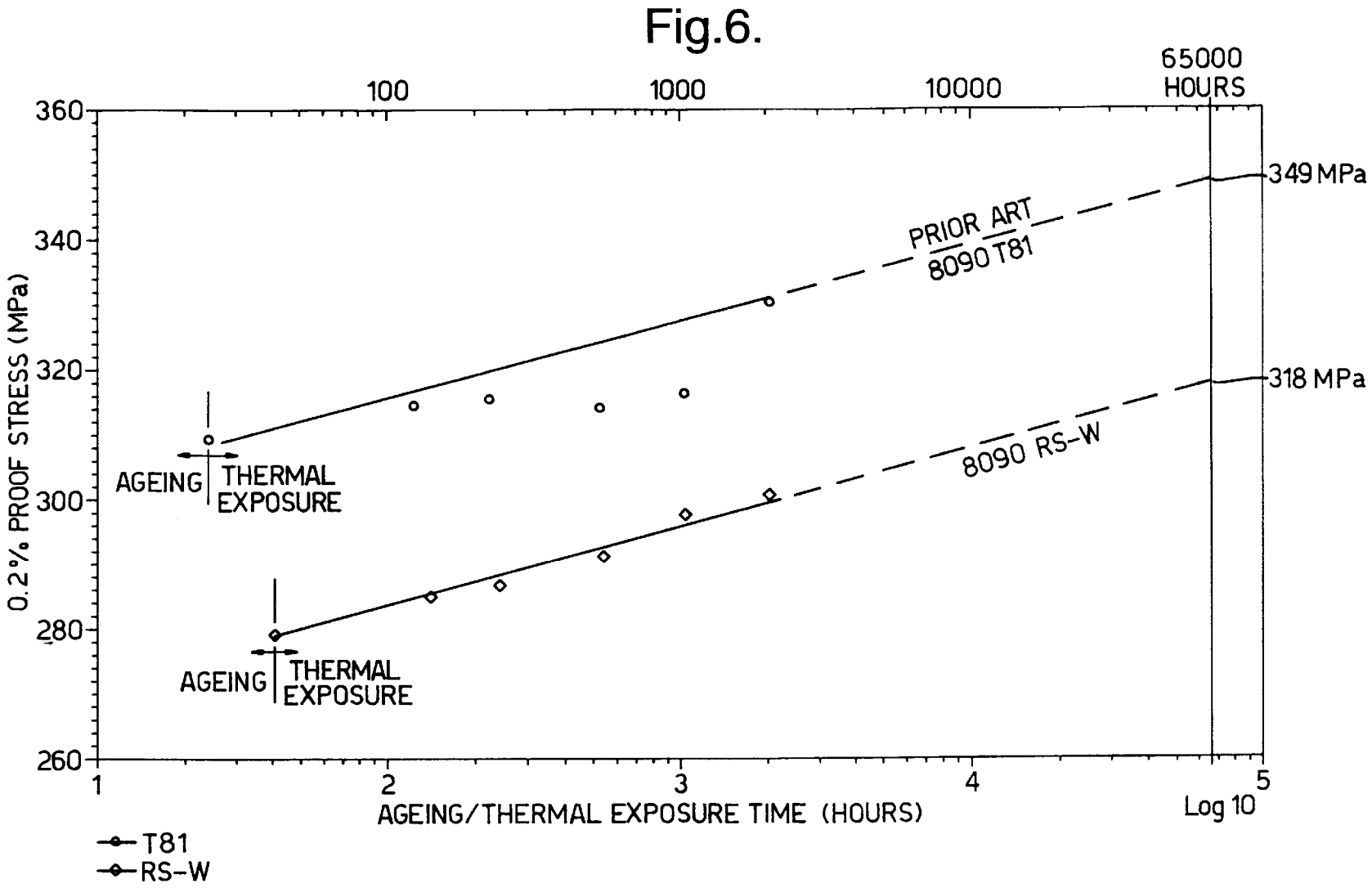
FIG. 6 is a graph comparing fracture toughness characteristics of the present invention with the prior art.

It is apparent from FIG. 6 that the T81 material has undergone an incubation period from approximately the 100 hours exposure point to somewhere slightly in excess of the 1000 hour exposure point during which virtually no change in 0.2% Proof Stress was apparent. There was then a rapid increase in 0.2% Proof Stress. In contrast, the RS-W aged material exhibited no such incubation effect and a steady rise in 0.2% Proof Stress versus Log Exposure Time is evidenced. It should be noted that the gradient of the two curves (excluding the incubation period for T81) appears almost identical thereby indicating that the "advantage" of lower strength in the RS-W material is being maintained and extrapolation to the 65000 hours point suggests that the T81 material would ultimately age to a 0.2% Proof Stress of approximately 349 MPa whereas that of the RS-W material would not exceed approximately 318 MPa. This represents an improvement in terms of preventing a strength increase of approximately 31 MPa that would otherwise occur.

However, this final predicted 0.2% Proof Stress level for Batch 2 RS-W material is regarded as approximately 25–30 MPa above a value considered compatible with a target of matching the plane stress fracture toughness of alclad 2024 T3. To achieve a further reduction in the level of the δ'-saturated 0.2% Proof Stress may require a compositional adjustment to be made in combination with the RS-W treatment. For the 8090 alloy it is believed that the magnesium level should be reduced from the 0.69% level present in Batch 2 to substantially the minimum level in the compositional registration (ie 0.6%), or even to below this value to as low as substantially 0.4%. This will further restrict the strengthening attributed to S' precipitation and will increase the solubility limit of lithium in aluminium thereby restricting the degree of δ' precipitation. Similarly, the lithium level may also need to be maintained at or even below the 8090 compositional minimum (ie 2.2%). Reducing the copper levels may be counterproductive in terms of toughness and so further dilution below the Batch 2 level may not be advisable.

To further illustrate the benefit of reducing the ageing temperature according to the invention in order to increase the volume fraction of the δ' precipitate some recrystallised 8090 T3.1 sheet was aged for 24 hours at 170° C. in order to reach a medium strength condition and then subsequently aged for 8 hours at 120° C. The longitudinal tensile properties after ageing for 24 hours at 170° C. according to the prior art are shown below together with the properties after the subsequent 8 hours period of ageing at 120° C. according to the invention. It can be seen that a significant increase in strength results from the inclusion of the relatively short ageing step at the lower temperature and that the final strength level attained is significantly higher than would have resulted from, say, 32 hours (ie 24+8 hours) at 170° C.

| Ageing Treatment | 0.2% Proof Stress (MPa) | Tensile Strength (MPa) | % Elongation |
|---|---|---|---|
| 24 hrs @ 170° C. | 374 | 468 | 7 |
| 24 hrs @ 170° C. + 8 hrs @ 120° C. | 406 | 499 | 8 |

The concept of RS-W ageing according to the invention to combine a prior art ageing step with a further ageing step or steps at reduced temperature to the initial ageing step to achieve a medium-to-high strength condition can therefore be seen to be advantageous in terms of maximising the strength that can be ultimately attained as well as achieving a given strength level in a shorter overall ageing time than would otherwise be possible. This type of processing is applicable to all Al—Li alloys strengthened, in part, by the precipitation of δ' and is applicable to all product forms such as plate, extrusions, forgings, tube etc. This particular form of the ageing treatment according to the invention is now termed High Strength Retrogressive Step-Wise ageing ("HSRS-W").

RANGE OF HEAT TREATMENTS

The nature of the heat treatment according to the RS-W aspect of the invention is such that there is a broad range of treatments which achieve approximately the same final condition. A very broad range of RS-W treatment intended to produce a condition of high plane stress fracture toughness is therefore disclosed and then various refinements culminating in a preferred range (RS-W Range 4) which is particularly suited to the 8090 alloy and which achieves an optimum combination of initial strength, toughness and thermal stability is disclosed.

The HSRS-W ageing treatment according to the invention combines the process of maximising the δ' volume fraction with an ageing treatment intended to produce a medium-to-high strength condition (ie high in S' and δ') to result in an increased strength level which is higher than would result from the initial prior art ageing treatment alone or from an isothermal ageing treatment of the same overall length which is solely carried out at the higher temperature.

For "short" ageing steps (ie less than or equal to substantially 3 hours) the time indicated may commence when the temperature of the product as determined by a contact-based temperature measuring device (thermocouple) reaches a temperature within 5° C. of the nominal temperature of the treatment. Typically, for a 150° C. ageing step applied to 1.6 mm thick sheet and with the sheets loaded into a pre-heated air circulation oven, a heat up time of 10 to 15 minutes has been found to be appropriate.

For ageing times longer than about 3 hours the lag between the metal and oven air temperatures can be ignored and the treatment time then commences when the oven air temperature recovers to the set temperature.

For very short ageing treatments the use of an oil bath or similar may be necessary in place of an air oven. In such cases appropriate adjustments to the metal heat up times will be needed.

Treatments below 90° C. are considered to be ineffective, according to the invention.

A continuous transition between the temperatures shown in any pair of adjoining steps is considered as part of the temperature ranges and time ranges specified.

| | Temperature Range | Time Range |
|---|---|---|
| RS-W TREATMENT-RANGE 1 | | |
| Step 1 | 165 to 130° C. | 15 Minutes to 24 Hours |
| Step 2 | 130 to 90° C. | 1 Hour to 72 Hours |
| RS-W TREATMENT-RANGE 2 | | |
| Step 1 | 160° C. to 130° C. | 30 Minutes to 12 Hours |
| Step 2 | 130° C. to 90° C. | 2 Hours to 72 Hours |
| RS-W TREATMENT-RANGE 3 | | |
| Step 1 | 150 ± 5° C. | 45 Minutes to 75 Minutes |
| Step 2 | 120 ± 5° C. | 4 to 12 Hours |
| Step 3 | 105 ± 5° C. | 12 to 36 Hours |
| Step 4 | 95 ± 5° C. | Zero to 24 Hours |
| RS-W TREATMENT-RANGE 4 | | |
| Step 1 | 150 ± 5° C. | 1 Hour ± 15 Minutes |
| Step 2 | 120 ± 5° C. | 8 ± 2 Hours |
| Step 3 | 105 ± 5° C. | 24 ± 6 Hours |
| Step 4 | 95 ± 5° C. | Zero to 8 Hours |

HSRS-W

The HSRS-W treatment ranges are described either as 2-step or as 3/4-step (ie 4-step treatment but with the fourth step optional which, if omitted, thereby results in a 3-step treatment).

| | Temperature Range | Time Range |
|---|---|---|
| HSRS-W TREATMENT-2-STEP, RANGE 1 | | |
| Step 1 | 190 ± 40° C. | 20 Minutes to 72 Hours |
| Step 2 | 120 ± 30° C. | 1 Hour to 48 Hours |
| HSRS-W TREATMENT-2-STEP, RANGE 2 | | |
| Step 1 | 170 ± 20° C. | 4 Hours to 48 Hours |
| Step 2 | 125 ± 15° C. | 4 Hours to 36 Hours |
| HSRS-W TREATMENT-2-STEP, RANGE 3 | | |
| Step 1 | 170 ± 20° C. | 12 Hours to 36 Hours |
| Step 2 | 125 ± 15° C. | 6 Hours to 24 Hours |
| HSRS-W TREATMENT-2-STEP, RANGE 4 | | |
| Step 1 | 170 ± 10° C. | 24 ± 4 Hours |
| Step 2 | 125 ± 10° C. | 8 ± 2 Hours |
| HSRS-W TREATMENT-3/4 STEP, RANGE 1 | | |
| Step 1 | 170 ± 20° C. | 4 Hours to 48 Hours |

-continued

| | Temperature Range | Time Range |
|---|---|---|
| Step 2 | 125 ± 15° C. | 6 Hours to 24 Hours |
| Step 3 | 105 ± 10° C. | 8 Hours to 30 Hours |
| Step 4 | 95 ± 5° C. | Zero to 8 Hours |
| HSRS-W TREATMENT-3/4-STEP, RANGE 2 | | |
| Step 1 | 170 ± 10° C. | 24 ± 4 Hours |
| Step 2 | 125 ± 10° C. | 8 ± 4 Hours |
| Step 3 | 105 ± 5° C. | 18 ± 6 Hours |
| Step 4 | 95 ± 5° C. | Zero to 8 Hours |

In summary the use of the RS-W ageing method of the invention provides a means of achieving a strength level for aluminium-lithium alloys such as 8090 which are strengthened by the precipitation of δ' and S' which is comparable with conventional aluminium-copper alloy materials whilst also restricting the degree of subsequent and unwanted strengthening and associated loss in fracture toughness which can take place due to prolonged exposure to moderately elevated temperatures such as are encountered by fuselage, wing and empennage skin structures during on-the-ground exposures when relatively high ambient temperatures exist and/or there is significant heating due to solar radiation.

The use of the HSRS-W ageing method of the invention provides a means of achieving a strength level for aluminium-lithium alloys such as 8090 which are strengthened by the precipitation of δ' and S' which is comparable with conventional aluminium-copper and also aluminium-zinc alloy materials The invention also provides a means of achieving an improved level of toughness of all other aluminium-lithium alloys whether in plate form, sheet form, extruded form or otherwise primarily strengthened by the precipitation of the δ' ($Al_3Li$) precipitate in conjunction with other precipitates such as S' ($Al_2CuMg$).

In addition the invention also provides an improvement in the resistance of the 8090 alloy in recrystallised sheet form to intergranular corrosion.

TABLE 1

| | AS-RECEIVED PROPERTIES | | | | PROPERTIES AFTER 920 HOURS @ 100° C. | | | |
|---|---|---|---|---|---|---|---|---|
| INITIAL CONDITION | 0.2% PROOF STRESS MPa | TENSILE STRENGTH MPa | ELONG. % | ELECT. COND. % IACS | 0.2% PROOF STRESS MPa | TENSILE STRENGTH MPa | ELONG. % | ELECT. COND. % IACS |
| T81 (T31 + 150° C./24 hours) | 293 | 424 | 13.5 | 18.8 | 320 | 439 | 10.2 | 19.6 |
| T81 + REVERSION (200° C./10 MINUTES) | 260 | 379 | 14.8 | 17.6 | 324 | 451 | 10.5 | 19.8 |
| T81 + 200° C./10 MINUTES + 170° C./4 HOURS | 295 | 416 | 13.6 | 18.6 | 339 | 471 | 10.0 | 20.5 |
| T81 + 220° C./12 HOURS | 346 | 411 | 8.4 | 18.5 | 394 | 471 | 5.4 | 20.4 |

ROOM TEMPERATURE MECHANICAL PROPERTIES AND ELECTRICAL CONDUCTIVITY OF BATCH 1 8090 IN VARIOUS INITIAL CONDITIONS AFTER 920 HOURS AT 100° C. THERMAL EXPOSURE.

TABLE 2A

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | 0.1% MPa | 0.2% MPa | 0.5% MPa | MPa | % | % IACS |
| 1 | — | — | — | — | — | 205 | 216 | 238 | 342 | 20.0 | 17.5 |
| 1 | 6 | — | — | — | — | 249 | 260 | 284 | 384 | 15.8 | 18.2 |
| 1 | 6 | 3 | — | — | — | 256 | 267 | 291 | 392 | 15.8 | 18.6 |
| 1 | 6 | 3 | 50 | — | — | 255 | 277 | 303 | 408 | 15.8 | 19.0 |
| 1 | 6 | 3 | 50 | 100 | — | 274 | 285 | 310 | 413 | 13.9 | 19.3 |
| 1 | 6 | 3 | 50 | 500 | — | 282 | 294 | 318 | 416 | 14.3 | 19.4 |
| 1 | 6 | 3 | 50 | 500 | 500 | 284 | 294 | 319 | 416 | 13.5 | 19.6 |

LONG TRANSVERSE TENSILE PROPERTIES AND ELECTRICAL CONDUCTIVITY MEASUREMENTS FOR BATCH 1 1.6 mm 8090 SHEET AT EACH STAGE OF AGEING FOR AGEING SEQUENCE 1 h/150° C. + 6 h/135° C. + 50 h/100° C. AND AFTER THERMAL EXPOSURE AT 85° C. & 70° C.
STARTING CONDITION: SOLUTION TREATED 505° C. AND CONTROLLED STRETCHED 2% ± 0.5% IN LONGITUDINAL DIRECTION.

TABLE 2B

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | 0.1% MPa | 0.2% MPa | 0.5% MPa | MPa | % | % IACS |
| 1 | — | — | — | — | — | 205 | 216 | 238 | 342 | 20.0 | 17.5 |
| 1 | 6 | — | — | — | — | 249 | 260 | 284 | 384 | 15.8 | 18.2 |
| 1 | 6 | 3 | — | — | — | 252 | 269 | 294 | 393 | 14.9 | 18.6 |
| 1 | 6 | 3 | 50 | — | — | 264 | 280 | 305 | 406 | 14.5 | 19.0 |
| 1 | 6 | 3 | 50 | 100 | — | 277 | 287 | 311 | 415 | 14.5 | 19.3 |
| 1 | 6 | 3 | 50 | 500 | — | 284 | 296 | 321 | 426 | 16.1 | 19.3 |
| 1 | 6 | 3 | 50 | 500 | 500 | 281 | 292 | 316 | 419 | 13.6 | 19.6 |

LONG TRANSVERSE TENSILE PROPERTIES AND ELECTRICAL CONDUCTIVITY MEASUREMENTS FOR BATCH 1 1.6 mm 8090 SHEET AT EACH STAGE OF AGEING FOR AGEING SEQUENCE 1 h/150° C. + 6 h/135° C. + 50 h/100° C. AND AFTER THERMAL EXPOSURE AT 85° C. & 70° C.
STARTING CONDITION: SOLUTION TREATED 505° C. AND CONTROLLED STRETCHED 2% ± 0.5% IN LONGITUDINAL DIRECTION.

TABLE 2C

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | 0.1% MPa | 0.2% MPa | 0.5% MPa | MPa | % | % IACS |
| 1 | — | — | — | — | — | 205 | 216 | 238 | 342 | 20.0 | 17.5 |
| 1 | 6 | — | — | — | — | 249 | 260 | 284 | 384 | 15.8 | 18.2 |
| 1 | 6 | 8 | — | — | — | 265 | 275 | 301 | 403 | 15.4 | 18.7 |
| 1 | 6 | 8 | 50 | — | — | 251 | 280 | 306 | 407 | 15.8 | 19.1 |
| 1 | 6 | 8 | 50 | 100 | — | 276 | 287 | 312 | 413 | 14.9 | 19.3 |
| 1 | 6 | 8 | 50 | 500 | — | 283 | 295 | 320 | 425 | 13.3 | 19.4 |
| 1 | 6 | 8 | 50 | 500 | 500 | 283 | 294 | 319 | 420 | 12.2 | 19.7 |

LONG TRANSVERSE TENSILE PROPERTIES AND ELECTRICAL CONDUCTIVITY MEASUREMENTS FOR BATCH 1 1.6 mm 8090 SHEET AT EACH STAGE OF AGEING FOR AGEING SEQUENCE 1 h/150° C. + 6 h/135° C. + 50 h/100° C. AND AFTER THERMAL EXPOSURE AT 85° C. & 70° C.
STARTING CONDITION: SOLUTION TREATED 505° C. AND CONTROLLED STRETCHED 2% ± 0.5% IN LONGITUDINAL DIRECTION.

TABLE 2D

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | 0.1% MPa | 0.2% MPa | 0.5% MPa | MPa | % | % IACS |
| 1 | — | — | — | — | — | 205 | 216 | 238 | 342 | 20.0 | 17.5 |
| 1 | 12 | — | — | — | — | 260 | 270 | 295 | 393 | 14.7 | 18.5 |
| 1 | 12 | 6 | — | — | — | 269 | 278 | 302 | 405 | 14.7 | 18.8 |
| 1 | 12 | 6 | 50 | — | — | 272 | 287 | 312 | 411 | 14.1 | 19.1 |
| 1 | 12 | 6 | 50 | 100 | — | 274 | 290 | 316 | 420 | 14.8 | 19.4 |
| 1 | 12 | 6 | 50 | 500 | — | 292 | 301 | 325 | 432 | 16.8 | 19.5 |
| 1 | 12 | 6 | 50 | 500 | 500 | 289 | 300 | 325 | 428 | 13.3 | 19.7 |

LONG TRANSVERSE TENSILE PROPERTIES AND ELECTRICAL CONDUCTIVITY MEASUREMENTS FOR BATCH 1 1.6 mm 8090 SHEET AT EACH STAGE OF AGEING FOR AGEING SEQUENCE 1 h/150° C. + 12 h/135° C./ + 6 h/120° C. + 50 h/100° C. AND AFTER THERMAL EXPOSURE AT 85° C. & 70° C.
STARTING CONDITION: SOLUTION TREATED 505° C. AND CONTROLLED STRETCHED 2% ± 0.5% IN LONGITUDINAL DIRECTION.

TABLE 2E

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | 0.1% MPa | 0.2% MPa | 0.5% MPa | MPa | % | % IACS |
| 1 | — | — | — | — | — | 205 | 216 | 238 | 342 | 20.0 | 17.5 |
| 1 | 12 | — | — | — | — | 260 | 270 | 295 | 393 | 14.7 | 18.5 |
| 1 | 12 | 16 | — | — | — | 274 | 284 | 309 | 410 | 15.5 | 18.9 |
| 1 | 12 | 16 | 50 | — | — | 274 | 289 | 314 | 417 | 13.6 | 19.2 |
| 1 | 12 | 16 | 50 | 100 | — | 283 | 295 | 319 | 422 | 12.8 | 19.5 |
| 1 | 12 | 16 | 50 | 500 | — | 290 | 299 | 324 | 427 | 11.8 | 19.6 |
| 1 | 12 | 16 | 50 | 500 | 500 | 292 | 302 | 327 | 427 | 12.5 | 19.8 |

LONG TRANSVERSE TENSILE PROPERTIES AND ELECTRICAL CONDUCTIVITY MEASUREMENTS FOR BATCH 1 1.6 mm 8090 SHEET AT EACH STAGE OF AGEING FOR AGEING SEQUENCE 1 h/150° C. + 12 h/135° C. + 16 h/120° C. + 50 h/100° C. AND AFTER THERMAL EXPOSURE AT 85° C. & 70° C.
STARTING CONDITION: SOLUTION TREATED 505° C. AND CONTROLLED STRETCHED 2% ± 0.5% IN LONGITUDINAL DIRECTION.

TABLE 2F

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | 0.1% MPa | 0.2% MPa | 0.5% MPa | MPa | % | % IACS |
| 3 | — | — | — | — | — | 237 | 247 | 270 | 372 | 16.0 | 17.9 |
| 3 | 12 | — | — | — | — | 266 | 279 | 304 | 406 | 15.0 | 18.7 |
| 3 | 12 | 6 | — | — | — | 277 | 287 | 311 | 415 | 17.4 | 19.0 |
| 3 | 12 | 6 | 50 | — | — | 264 | 293 | 318 | 421 | 14.3 | 19.3 |
| 3 | 12 | 6 | 50 | 100 | — | 285 | 296 | 322 | 423 | 13.3 | 19.6 |
| 3 | 12 | 6 | 50 | 500 | — | 291 | 301 | 325 | 429 | 13.6 | 19.7 |
| 3 | 12 | 6 | 50 | 500 | 500 | 291 | 302 | 326 | 429 | 14.1 | 19.9 |

LONG TRANSVERSE TENSILE PROPERTIES AND ELECTRICAL CONDUCTIVITY MEASUREMENTS FOR BATCH 1 1.6 mm 8090 SHEET AT EACH STAGE OF AGEING FOR AGEING SEQUENCE 3 h/150° C. + 12 h/135° C. + 6 h/120° C. + 50 h/100° C. AND AFTER THERMAL EXPOSURE AT 85° C. & 70° C.
STARTING CONDITION: SOLUTION TREATED 505° C. AND CONTROLLED STRETCHED 2% ± 0.5% IN LONGITUDINAL DIRECTION.

TABLE 2G

| AGEING TREATMENT (HOURS AT TEMPERATURE) | | | | THERMAL SENSITISATION | | PROOF STRESS 0.1% | 0.2% | 0.5% | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | MPa | MPa | MPa | MPa | % | % IACS |
| 3 | — | — | — | — | — | 237 | 247 | 270 | 372 | 16.0 | 17.9 |
| 3 | 12 | — | — | — | — | 266 | 279 | 304 | 406 | 15.0 | 18.7 |
| 3 | 12 | 16 | — | — | — | 280 | 291 | 316 | 422 | 16.5 | 19.1 |
| 3 | 12 | 16 | 50 | — | — | 275 | 291 | 317 | 418 | 13.3 | 19.4 |
| 3 | 12 | 16 | 50 | 100 | — | 279 | 298 | 324 | 426 | 12.3 | 19.6 |
| 3 | 12 | 16 | 50 | 500 | — | 294 | 303 | 328 | 434 | 12.6 | 19.7 |
| 3 | 12 | 16 | 50 | 500 | 500 | 294 | 306 | 331 | 436 | 11.8 | 20.0 |

LONG TRANSVERSE TENSILE PROPERTIES AND ELECTRICAL CONDUCTIVITY MEASUREMENTS FOR BATCH 1 1.6 mm 8090 SHEET AT EACH STAGE OF AGEING FOR AGEING SEQUENCE 3 h/150° C. + 12 h/135° C. + 6 h/120° C. + 50 h/100° C. AND AFTER THERMAL EXPOSURE AT 85° C. & 70° C.
STARTING CONDITION: SOLUTION TREATED 505° C. AND CONTROLLED STRETCHED 2% ± 0.5% IN LONGITUDINAL DIRECTION.

TABLE 3A

| AGEING TREATMENT (HOURS AT TEMPERATURE) | | | | THERMAL SENSITISATION | | PROOF STRESS 0.1% | 0.2% | 0.5% | TENSILE STRENGTH | ELONGATION | ROOM TEMP. ELECTRICAL CONDUCTIVITY |
|---|---|---|---|---|---|---|---|---|---|---|---|
| 150° C. | 135° C. | 120° C. | 100° C. | 85° C. | 70° C. | MPa | MPa | MPa | MPa | % | % IACS |
| 1 | — | — | — | — | — | 224.2 | 232.0 | 254.3 | 366.3 | 20.6 | 16.4 |
| 1 | 6 | — | — | — | — | 259.1 | 267.3 | 290.8 | 398.2 | 18.5 | 17.5 |
| 1 | 6 | 8 | — | — | — | 275.4 | 283.4 | 307.9 | 414.3 | 14.4 | 17.9 |
| 1 | 6 | 8 | 50 | — | — | 287.2 | 295.1 | 320.2 | 430.0 | 16.8 | 18.3 |
| 1 | 6 | 8 | 50 | 100 | — | 288.7 | 296.5 | 320.9 | 429.8 | 17.2 | 18.5 |
| 1 | 6 | 8 | 50 | 250 | — | 290.5 | 298.0 | 322.1 | 429.3 | 14.6 | 18.6 |
| 1 | 6 | 8 | 50 | 250 | 500 | 297.3 | 309.7 | 328.3 | 434.5 | 12.7 | 18.8 |
| 1 | 6 | 8 | 50 | — | — | (301.7) | (307.3) | (320.6) | (415.2) | (12.8) | (18.3) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 1 h/150° C. + 6 h/135° C. + 8 h/120° C. + 50 h/100° C. AND AFTER THERMAL EXPOSURE AT 85° C. & 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

TABLE 3B

| AGEING TREATMENT (HOURS AT TEMPERATURE) | | | | THERMAL SENSITISATION | | PROOF STRESS 0.1% | 0.2% | 0.5% | TENSILE STRENGTH | ELONGATION | ROOM TEMP. ELECTRICAL CONDUCTIVITY |
|---|---|---|---|---|---|---|---|---|---|---|---|
| 150° C. | 120° C. | 105° C. | 95° C. | 85° C. | 70° C. | MPa | MPa | MPa | MPa | % | % IACS |
| 1 | — | — | — | — | — | 224.2 | 232.0 | 254.3 | 366.3 | 20.6 | 16.4 |
| 1 | 8 | — | — | — | — | 253.7 | 260.9 | 283.3 | 394.3 | 18.3 | 17.4 |
| 1 | 8 | 24 | — | — | — | 268.1 | 275.5 | 299.2 | 409.7 | 18.0 | 17.8 |
| 1 | 8 | 24 | 24 | — | — | 274.1 | 281.8 | 306.2 | 413.6 | 19.1 | 17.9 |
| 1 | 8 | 24 | 24 | 100 | — | 277.4 | 284.7 | 308.4 | 416.3 | 14.7 | 18.2 |
| 1 | 8 | 24 | 24 | 250 | — | 283.2 | 291.0 | 315.8 | 422.4 | 17.7 | 18.3 |
| 1 | 8 | 24 | 24 | 250 | 500 | 288.5 | 296.1 | 320.5 | 427.0 | 16.8 | 18.4 |
| 1 | 8 | 24 | 24 | 250 | 500 | 287.9 | 294.7 | 317.7 | 426.9 | 19.5 | 18.4 |
| 1 | 8 | 24 | 24 | — | — | (288.7) | (293.5) | (305.9) | (402.5) | (13.9) | (17.9) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 1 h/150° C. + 8 h/120° C. + 24 h/105° C. + 24 h/95° C. AND AFTER THERMAL EXPOSURE AT 85° C., 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

TABLE 3C

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 150° C. | 120° C. | 105° C. | 95° C. | 85° C. | 70° C. | MPa | MPa | MPa | MPa | % | % IACS |
| 1 | — | — | — | — | — | 224.2 | 232.0 | 254.3 | 366.3 | 20.6 | 16.4 |
| 1 | 16 | — | — | — | — | 264.4 | 272.1 | 295.1 | 405.7 | 18.5 | 17.5 |
| 1 | 16 | 24 | — | — | — | 274.1 | 281.9 | 305.7 | 415.6 | 19.0 | 18.0 |
| 1 | 16 | 24 | 24 | — | — | 276.9 | 284.5 | 309.1 | 419.7 | 16.4 | 18.1 |
| 1 | 16 | 24 | 24 | 100 | — | 274.8 | 282.5 | 306.1 | 417.7 | 17.6 | 18.3 |
| 1 | 16 | 24 | 24 | 250 | — | 285.8 | 293.6 | 317.9 | 424.5 | 14.4 | 18.4 |
| 1 | 16 | 24 | 24 | 250 | 500 | 290.7 | 298.4 | 323.2 | 433.6 | 17.6 | 18.6 |
| 1 | 16 | 24 | 24 | — | — | (299.4) | (304.7) | (316.3) | (405.7) | (12.6) | (18.1) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 1 h/150° C. + 16 h/120° C. + 24 h/105° C. + 24 h/95° C. AND AFTER THERMAL EXPOSURE AT 85° C., 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

20

TABLE 3D

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 150° C. | 125° C. | 105° C. | 95° C. | 85° C. | 70° C. | MPa | MPa | MPa | MPa | % | % IACS |
| 1 | — | — | — | — | — | 224.2 | 232.0 | 254.3 | 366.3 | 20.6 | 16.4 |
| 1 | 8 | — | — | — | — | 254.5 | 263.2 | 286.4 | 398.2 | 18.7 | 17.4 |
| 1 | 8 | 24 | — | — | — | 269.8 | 277.7 | 300.7 | 410.8 | 14.1 | 17.9 |
| 1 | 8 | 24 | 24 | — | — | 275.6 | 282.9 | 306.6 | 417.4 | 17.7 | 18.1 |
| 1 | 8 | 24 | 24 | 100 | — | 282.0 | 289.3 | 312.3 | 423.8 | 17.1 | 18.3 |
| 1 | 8 | 24 | 24 | 250 | — | 286.6 | 294.1 | 318.0 | 428.3 | 16.5 | 18.4 |
| 1 | 8 | 24 | 24 | 250 | 500 | 287.3 | 294.8 | 318.7 | 424.9 | 17.1 | 18.5 |
| 1 | 8 | 24 | 24 | 250 | 500 | 286.0 | 293.1 | 316.5 | 424.6 | 16.3 | 18.5 |
| 1 | 8 | 24 | 24 | — | — | (293.7) | (299.6) | (312.1) | (403.2) | (12.7) | (18.0) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 1 h/150° C. + 8 h/125° C. + 24 h/105° C. + 24 h/95° C. AND AFTER THERMAL EXPOSURE AT 85° C., 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

TABLE 3E

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 150° C. | 125° C. | 105° C. | 95° C. | 85° C. | 70° C. | MPa | MPa | MPa | MPa | % | % IACS |
| 1 | — | — | — | — | — | 224.2 | 232.0 | 254.3 | 366.3 | 20.6 | 16.4 |
| 1 | 16 | — | — | — | — | 267.1 | 274.9 | 298.8 | 406.9 | 17.6 | 17.6 |
| 1 | 16 | 24 | — | — | — | 279.6 | 287.4 | 311.6 | 420.6 | 20.1 | 18.1 |
| 1 | 16 | 24 | 24 | — | — | 285.1 | 292.7 | 317.0 | 425.6 | 14.9 | 18.2 |
| 1 | 16 | 24 | 24 | 100 | — | 287.9 | 295.4 | 319.2 | 428.0 | 14.8 | 18.4 |
| 1 | 16 | 24 | 24 | 250 | — | 291.5 | 299.4 | 324.7 | 435.7 | 15.9 | 18.5 |
| 1 | 16 | 24 | 24 | 250 | 500 | 293.2 | 300.5 | 324.0 | 433.9 | 15.8 | 18.7 |
| 1 | 16 | 24 | 24 | — | — | (301.4) | (306.8) | (318.7) | (410.2) | (12.4) | (18.2) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 1 h/150° C. + 16 h/125° C. + 24 h/105° C. + 24 h/95° C. AND AFTER THERMAL EXPOSURE AT 85° C., 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

65

TABLE 3F

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 135° C. | 120° C. | 105° C. | 95° C. | 85° C. | 70° C. | MPa | MPa | MPa | MPa | % | % IACS |
| 1 | — | — | — | — | — | 198.4 | 205.9 | 225.8 | 341.6 | 22.4 | 15.9 |
| 1 | 8 | — | — | — | — | 232.2 | 239.4 | 260.6 | 374.4 | 19.3 | 16.8 |
| 1 | 8 | 24 | — | — | — | 252.1 | 259.5 | 282.1 | 399.3 | 20.3 | 17.4 |
| 1 | 8 | 24 | 24 | — | — | 256.6 | 264.2 | 286.5 | 399.0 | 20.3 | 17.5 |
| 1 | 8 | 24 | 24 | 100 | — | 267.3 | 274.9 | 298.3 | 412.8 | 19.5 | 17.9 |
| 1 | 8 | 24 | 24 | 250 | — | 278.2 | 285.6 | 309.3 | 418.3 | 15.5 | 18.0 |
| 1 | 8 | 24 | 24 | 250 | 500 | 279.4 | 286.6 | 309.4 | 420.3 | 16.3 | 18.2 |
| 1 | 8 | 24 | 24 | 250 | 1250 | 283.8 | 290.5 | 313.0 | 425.4 | 17.2 | 18.2 |
| 1 | 8 | 24 | 24 | — | — | (273.9) | (278.3) | (290.8) | (386.9) | (10.5) | (17.5) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 1 h/135° C. + 8 h/120° C. + 24 h/105° C. + 24 h/95° C. AND AFTER THERMAL EXPOSURE AT 85° C. & 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

TABLE 3G

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 135° C. | 120° C. | 105° C. | 95° C. | 85° C. | 70° C. | MPa | MPa | MPa | MPa | % | % IACS |
| 1 | — | — | — | — | — | 198.4 | 205.9 | 225.8 | 341.6 | 22.4 | 15.9 |
| 1 | 16 | — | — | — | — | 245.3 | 252.7 | 274.8 | 387.5 | 22.8 | 17.2 |
| 1 | 16 | 24 | — | — | — | 258.9 | 266.2 | 288.8 | 400.0 | 19.0 | 17.5 |
| 1 | 16 | 24 | 24 | — | — | 261.8 | 269.6 | 292.5 | 395.5 | 16.4 | 17.8 |
| 1 | 16 | 24 | 24 | 100 | — | 270.2 | 277.2 | 299.5 | 414.8 | 18.1 | 18.0 |
| 1 | 16 | 24 | 24 | 250 | — | 280.2 | 287.9 | 311.9 | 420.6 | 15.9 | 18.1 |
| 1 | 16 | 24 | 24 | 250 | 500 | 282.4 | 288.9 | 311.6 | 417.6 | 16.7 | 18.3 |
| 1 | 16 | 24 | 24 | 250 | 1250 | 289.2 | 296.5 | 319.7 | 425.8 | 14.9 | 18.4 |
| 1 | 16 | 24 | 24 | — | — | (286.6) | (292.0) | (303.8) | (399.5) | (11.8) | (17.8) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 1 h/135° C. + 16 h/120° C. + 24 h/105° C. + 24 h/95° C. AND AFTER THERMAL EXPOSURE AT 85° C., 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

TABLE 3H

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 135° C. | 120° C. | 105° C. | 95° C. | 85° C. | 70° C. | MPa | MPa | MPa | MPa | % | % IACS |
| — | 2 | — | — | — | — | 189.5 | 196.2 | 213.5 | 336.1 | 20.7 | 15.7 |
| — | 2 | 32 | — | — | — | 235.2 | 242.2 | 263.5 | 375.5 | 21.4 | 16.8 |
| — | 2 | 32 | 24 | — | — | 242.7 | 249.9 | 271.3 | 386.7 | 18.6 | 17.1 |
| — | 2 | 32 | 24 | 100 | — | 256.2 | 263.6 | 286.2 | 403.7 | 19.3 | 17.5 |
| — | 2 | 32 | 24 | 250 | — | 267.7 | 274.9 | 297.2 | 411.9 | 16.9 | 17.7 |
| — | 2 | 32 | 24 | 250 | 500 | 272.4 | 279.2 | 301.3 | 414.3 | 15.8 | 18.0 |
| — | 2 | 32 | 24 | 250 | 1250 | 276.1 | 283.5 | 306.5 | 412.5 | 17.1 | 18.0 |
| — | 2 | 32 | 24 | — | — | (260.0) | (263.8) | (274.8) | (377.4) | (16.6) | (17.1) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 2 h/120° C. + 32 h/120° C. + 24 h/95° C. AND AFTER THERMAL EXPOSURE AT 85° C. & 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

TABLE 3J

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 135° C. | 120° C. | 105° C. | 95° C. | 85° C. | 70° C. | MPa | MPa | MPa | MPa | % | % IACS |
| — | 8 | — | — | — | — | 217.8 | 224.9 | 244.8 | 364.1 | 21.5 | 16.4 |
| — | 8 | 24 | — | — | — | 240.6 | 247.5 | 268.4 | 389.9 | 18.6 | 17.1 |
| — | 8 | 24 | 24 | — | — | 249.5 | 256.7 | 279.1 | 388.7 | 18.3 | 17.4 |
| — | 8 | 24 | 24 | 100 | — | 262.6 | 269.6 | 291.0 | 408.8 | 16.5 | 17.6 |
| — | 8 | 24 | 24 | 250 | — | 271.9 | 278.6 | 300.9 | 415.9 | 19.1 | 17.8 |
| — | 8 | 24 | 24 | 250 | 500 | 271.3 | 278.6 | 300.7 | 413.1 | 20.5 | 18.1 |
| — | 8 | 24 | 24 | 250 | 1250 | 279.0 | 286.0 | 308.7 | 416.4 | 17.0 | 18.1 |
| — | 8 | 24 | 24 | — | — | (265.2) | (269.8) | (281.1) | (384.1) | (167.6 | (17.3) |

LONG TRANSVERSE TENSILE PROPERTIES AND ELECTRICAL CONDUCTIVITY MEASUREMENTS FOR BATCH 2 1.9 mm 8090 SHEET AT EACH STAGE OF AGEING FOR AGEING SEQUENCE 8 h/120° C. + 24 h/120° C. + 24 h/95° C. AND AFTER THERMAL EXPOSURE AT 85° C. & 70° C. (LONGITUDINAL RESULTS SHOWN IN PARENTHESIS).
STARTING CONDITION: SOLUTION TREATED 530° C. AND CONTROLLED STRETCHED 2% ± 0.5% IN LONGITUDINAL DIRECTION.

20

TABLE 4A

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 150° C. | 120° C. | 105° C. | 95° C. | 85° C. | 70° C. | MPa | MPa | MPa | MPa | % | % IACS |
| 0.75 | 8 | — | — | — | — | 241.6 | 248.7 | 271.3 | 389.4 | 20.7 | 17.6 |
| 0.75 | 8 | 24 | — | — | — | 261.6 | 268.4 | 291.4 | 405.2 | 20.1 | 18.0 |
| 0.75 | 8 | 24 | 8 | — | — | 262.5 | 270.2 | 294.4 | 406.3 | 18.6 | 18.2 |
| 0.75 | 8 | 24 | 24 | 100 | — | 268.3 | 276.1 | 300.6 | 417.5 | 19.6 | 18.2 |

LONG TRANSVERSE TENSILE PROPERTIES AND ELECTRICAL CONDUCTIVITY MEASUREMENTS FOR BATCH 2 1.6 mm 8090 SHEET AT EACH STAGE OF AGEING FOR AGEING SEQUENCE 0.75 h/150° C. + 8 h/120° C. + 24 h/105° C. + 8 h/95° C. OR 24 h/95° C.
STARTING CONDITION: SOLUTION TREATED 530° C. AND CONTROLLED STRETCHED 1.75% ± 0.25% IN LONGITUDINAL DIRECTION.

TABLE 4B

| AGEING TREATMENT (HOURS AT TEMPERATURE) | | | | THERMAL SENSITISATION | | PROOF STRESS | | | TENSILE STRENGTH | ELONGATION | ROOM TEMP. ELECTRICAL CONDUCTIVITY |
|---|---|---|---|---|---|---|---|---|---|---|---|
| | | | | | | 0.1% | 0.2% | 0.5% | | | |
| 150° C. | 120° C. | 105° C. | 95° C. | 85° C. | 70° C. | MPa | MPa | MPa | MPa | % | % IACS |
| 1.00 | 8 | — | — | — | — | 250.1 | 258.2 | 283.4 | 394.4 | 18.3 | 17.8 |
| 1.00 | 8 | 24 | — | — | — | 266.7 | 274.8 | 299.7 | 411.3 | 19.3 | 18.1 |
| 1.00 | 8 | 24 | 8 | — | — | 272.1 | 280.2 | 305.8 | 421.0 | 18.1 | 18.3 |
| 1.00 | 8 | 24 | 24 | — | — | 273.6 | 281.5 | 306.3 | 415.8 | 16.2 | 18.3 |

LONG TRANSVERSE TENSILE PROPERTIES AND ELECTRICAL CONDUCTIVITY MEASUREMENTS FOR BATCH 2 1.6 mm 8090 SHEET AT EACH STAGE OF AGEING FOR AGEING SEQUENCE 1 h/150° C. + 8 h/120° C. + 24 h/105° C. + 8 h/95° C. OR 24 h/95° C.
STARTING CONDITION: SOLUTION TREATED 530° C. AND CONTROLLED STRETCHED 1.75% ± 0.25% IN LONGITUDINAL DIRECTION.

55

TABLE 4C

| AGEING TREATMENT (HOURS AT TEMPERATURE) | | | | THERMAL SENSITISATION | | PROOF STRESS | | | TENSILE | | ROOM TEMP. ELECTRICAL |
|---|---|---|---|---|---|---|---|---|---|---|---|
| | | | | | | 0.1% | 0.2% | 0.5% | STRENGTH | ELONGATION | CONDUCTIVITY |
| 150° C. | 120° C. | 105° C. | 95° C. | 85° C. | 70° C. | MPa | MPa | MPa | MPa | % | % IACS |
| 1.25 | 8 | — | — | — | — | 247.8 | 255.1 | 278.6 | 391.4 | 18.9 | 17.9 |
| 1.25 | 8 | 24 | — | — | — | 270.7 | 278.9 | 304.5 | 415.2 | 16.8 | 18.2 |
| 1.25 | 8 | 24 | 8 | — | — | 272.9 | 280.9 | 306.2 | 419.7 | 16.8 | 18.3 |
| 1.25 | 8 | 24 | 24 | — | — | 272.2 | 279.4 | 303.4 | 416.8 | 18.0 | 18.4 |

LONG TRANSVERSE TENSILE PROPERTIES AND ELECTRICAL CONDUCTIVITY MEASUREMENTS FOR BATCH 2 1.6 mm 8090 SHEET AT EACH STAGE OF AGEING FOR AGEING SEQUENCE 1.25 h/150° C. + 8 h/120° C. + 24 h/105° C. + 8 h/95° C. OR 24 h/95° C.
STARTING CONDITION: SOLUTION TREATED 530° C. AND CONTROLLED STRETCHED 1.75% ± 0.25% IN LONGITUDINAL DIRECTION.

TABLE 5

ROOM TEMPERATURE LONG TRANSVERSE TENSILE PROPERTIES FOR BATCH 2 1.6 mm 8090 SHEET 70° C. THERMAL EXPOSURE TRIAL INVOLVING T81 AND MATERIAL AGED TO THE PREFERRED RS-W CONDITION (i.e. 1h/150° C. + 8h/120° C. + 24h/105° C. + 8h/95° C.).

| THERMAL EXPOSURE HOURS @ 70° C. | STARTING CONDITION | 0.2% PROOF STRESS MPa | TENSILE STRENGTH MPa | ELONGATION % |
|---|---|---|---|---|
| -(CONTROL) | T81 | 309.4[1] | 441.3[1] | 13.3[1] |
| -(CONTROL) | RS-W | 279.0[2] | 413.7[2] | 16.6[2] |
| 100 | T81 | 314.5 | 449.4 | 13.9 |
| 100 | RS-W | 284.9[1] | 416.7[1] | 16.8[1] |
| 200 | T81 | 315.5 | 446.1 | 14.2 |
| 200 | RS-W | 286.7[1] | 422.3[1] | 17.3[1] |
| 500 | T81 | 314.2 | 451.9 | 13.3 |
| 500 | RS-W | 291.2[1] | 431.7[1] | 15.8[1] |
| 1000 | T81 | 316.4 | 454.3 | 11.1 |
| 1000 | RS-W | 297.7[1] | 440.4[1] | 16.1[1] |
| 2000 | T81 | 330.7[1] | 466.3[1] | 12.6[1] |
| 2000 | RS-W | 300.8[1] | 436.9[1] | 15.7[1] |

[1]Average of 2 tests.
[2]Average of 16 tests. The extreme highest and lowest values of 0.2% Proof Stress for the RS-W "Control" tests were 2.3 MPa above the mean and 2.5 MPa below the mean.

I claim:

1. A method of heat treating an aluminum—lithium alloy including carrying out a succession of at least two artificial ageing steps, said treated alloy having a yield strength of less than 70 ksi, the first such step being carried out within a time range of 15 minutes to 24 hours and within a first temperature range of 165° C. to 130° C. and a second step being carried out within a time range of 1 hour to 72 hours and within a reduced temperature range of 130° C. to 90° C.

2. A method as in claim 1 including carrying out the first artificial ageing step substantially within a temperature range 160° C. to 130° C. and substantially within a time range of 30 minutes to 12 hours and thereafter carrying out said second artificial ageing step substantially within a time range of 2 hours to 72 hours.

3. A method as in claim 1 including carrying out the first artificial ageing step substantially within a temperature range of 155° C. to 145° C. and substantially within a time range of 45 minutes to 75 minutes, thereafter carrying out said second artificial ageing step substantially within a temperature range 125° C. to 115° C. and substantially within a time range 4 hours to 12 hours, thereafter carrying out a third artificial ageing step substantially within a temperature range 110° C. to 100° C. and substantially within a time range 12 hours to 36 hours and thereafter carrying out a fourth artificial ageing step substantially within a temperature range 100° C. to 90° C. and substantially within a time range 0 hours to 24 hours.

4. A method as in claim 1 including carrying out the first artificial ageing step substantially within a temperature range 155° C. to 145° C. and substantially within a time range 45 minutes to 75 minutes, thereafter carrying out a second artificial ageing step substantially within a temperature range 125° C. to 115° C. and substantially within a time range 6 hours to 10 hours, thereafter carrying out a third artificial ageing step substantially within a temperature range 110° C. to 100° C. and substantially within a time range 18 hours to 30 hours and thereafter carrying out a fourth artificial ageing step substantially within a temperature range 100° C. to 90° C. and substantially within a time range 0 hours to 8 hours.

5. A method of forming an adhesively bonded heat treated structure of at least two components at least one of which comprises aluminium-lithium alloy, the method including the steps of forming a pre-cure assembly of the components and adhesive and heat treating the assembly according to the method of claim 1 whereby to cure the adhesive during at least one of the artificial ageing steps and so form the adhesively bonded heat treated structure.

6. A method of heat treating an aluminum—lithium alloy as in claim 1, wherein said aluminum—lithium alloy is 8090 alloy.

7. A method of treating aluminum—lithium alloy for use in an aviation environment, said treated alloy having a yield strength of less than 70 ksi, said environment involving prolonged and/or repeated thermal exposure to temperatures up to the temperature range of from 70° C.–85° C., where toughness of the treated material is not significantly reduced by such thermal exposure, said method includes the carrying out of a succession of at least two artificial ageing steps, the first such step being carried out within a time range of 15 minutes to 24 hours and within a first temperature range of 165° C. to 130° C. and a second step being carried out within a time range of 1 hour to 72 hours and within a temperature range of 130° C. to 90° C.

8. A method of heat treating an aluminum—lithium alloy including carrying out a succession of at least two artificial ageing steps, the first such step being carried out within a time range of 15 minutes to 24 hours and within a first temperature range of 165° C. to 130° C. and a second step being carried out within a time range of 1 hour to 72 hours and within a reduced temperature range of 130° C. to 90° C., wherein a typical value of the Long Transverse (LT) 0.2% proof stress of the resultant treated material is not greater than about 292.7 MPa.

* * * * *